US006578554B2

(12) United States Patent
Schroeer

(10) Patent No.: US 6,578,554 B2
(45) Date of Patent: Jun. 17, 2003

(54) FUEL INJECTION ARRANGEMENT

(75) Inventor: Markus Schroeer, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 09/683,518

(22) Filed: Jan. 11, 2002

(65) Prior Publication Data

US 2002/0139352 A1 Oct. 3, 2002

(30) Foreign Application Priority Data

Jan. 12, 2001 (GB) ..... 01100697

(51) Int. Cl.[7] ..... F02M 37/04
(52) U.S. Cl. ..... 123/470
(58) Field of Search ..... 123/470, 467

(56) References Cited

U.S. PATENT DOCUMENTS 2,777,431 A * 1/1957 Meurer ..... 123/470
3,038,456 A * 6/1962 Dreisin ..... 123/470
3,382,851 A * 5/1968 Luca ..... 123/470
3,841,277 A * 10/1974 Schafer ..... 123/470
3,941,109 A * 3/1976 Schmid ..... 123/470
4,133,321 A * 1/1979 Hofmann et al. ..... 123/470
4,294,215 A * 10/1981 Hans et al. ..... 123/470
4,506,645 A * 3/1985 Hewlitt et al. ..... 123/470
4,528,959 A * 7/1985 Hauser, Jr. ..... 123/470
4,589,596 A * 5/1986 Stumpp et al. ..... 123/470
4,647,012 A * 3/1987 Gartner ..... 123/470
4,829,965 A * 5/1989 Gartner ..... 123/470
5,044,340 A * 9/1991 Robnett ..... 123/470
5,125,383 A * 6/1992 Meier et al. ..... 123/470

* cited by examiner

*Primary Examiner*—Thomas N. Moulis
(74) *Attorney, Agent, or Firm*—Carlos Hanze

(57) ABSTRACT

The invention relates to a fuel injection arrangement for the cylinder of an internal combustion engine, containing a fuel injector mounted on the cylinder head of the cylinder. A damping material in the form of a shim is arranged between the contact faces, extending transversely to the longitudinal axis of the fuel injector, of the fuel injector, on the one hand, and of the cylinder head, on the other hand, in order to suppress the transmission of vibrations and sound.

7 Claims, 1 Drawing Sheet

FUEL INJECTION ARRANGEMENT

BACKGROUND OF INVENTION

1. Field of the Invention

The invention relates to a fuel injection arrangement for the cylinder of an internal combustion engine, with a fuel injector mounted on the cylinder head of the cylinder.

2. Background Art

A fuel injection arrangement of the type initially mentioned is known from U.S. Pat. No. 6,009,856. In this arrangement, the fuel injector serves, in a known way, for injecting fuel into the cylinder space of the internal combustion engine. In modern very high-performance fuel injection systems, pronounced vibrations and noise emissions occur during operation. In order to reduce these emissions, it is proposed, according to U.S. Pat. No. 6,009,856, to embed the fuel injector into a cylindrical sleeve by means of an elastic noise-damping substance. This sleeve is supported with its lower end face on the cylinder head, while the fuel injector is screwed to the cylinder head via flanges and screws running in the longitudinal direction of the fuel injector. Depending on the amount by which the screws are tightened, the fuel injector can be pressed to a varying depth into the embedding substance in the sleeve. In particular, in the mounted state, the screw connections of the fuel injector are tightened so firmly that the associated flanges sit on the upper end face of the sleeve. However, fastening the fuel injector in this way is highly complicated, since it requires the complete embedding of the fuel injector into an elastic substance and the surrounding of the latter by a sleeve. Renewal of the bedding in the event of the latter being damaged or undergoing aging is not possible, in practice, in the arrangement already known.

Against this background, the object of the present invention was to provide a simplified fuel injection arrangement with good noise insulation.

SUMMARY OF INVENTION

The fuel injection arrangement in accordance with the present invention includes a fuel injector that is fastened to a cylinder head of an internal combustion engine. The arrangement is defined in that a damping material is arranged between the contact faces, extending, as a rule, transversely, but also up to an angle of 45°, to the longitudinal axis of the fuel injector, of the fuel injector, on the one hand, and of the cylinder head, on the other hand.

When the fuel injector is fastened by means of holding forces running in the axial direction, for example by means of screws running in the axial direction, the contact faces, extending transversely to the longitudinal axis of the fuel injector, on the fuel injector, on the one hand, and on the cylinder head, on the other hand, are under a force load running essentially perpendicularly to the contact faces. This perpendicular force load is absorbed or transferred by the damping material between the contact faces, the damping material advantageously undergoing straightforward compression without shear forces.

In a further advantageous embodiment of the invention, the parting plane between the fuel injector and the cylinder head runs at an angle of 45° to the longitudinal axis of the fuel injector.

The damping material is preferably designed in the form of a shim, surrounding the fuel injector annularly. Such an annular design of the damping material makes it possible to mount the damping material on the fuel injector in a particularly simple and at the same time reliable way.

According to a preferred embodiment of the invention, the damping material consists of a plurality of plies. In particular, it may consist of four to six plies. The plies can be constructed of different or same materials. By different plies of the damping material being used, the thickness of the entire layer can be set as required. Furthermore, by the use of different materials, each having special properties, a specific desired damping behavior can be set in a controlled way.

The layer-like damping material preferably has a total thickness of about 2 to 3 mm. In the case of a multiple damping materials, the layer-like damping material preferably includes various plies of the same thickness, for example five plies, each with a thickness of 0.5 mm.

The damping material may be metal, rubber and/or a plastic, in particular a tetrafluoroethylene material (Teflon®).

The materials used, on the one hand, must have the desired damping behavior for vibrations and noises which are generated in the fuel injector and, on the other hand, must have sufficient mechanical and thermal stability to withstand the loads to which they are exposed while the fuel injection arrangement is in operation. The materials mentioned above have proved particularly advantageous in this respect.

Further advantages, objects and features of the invention will become apparent from the following detailed description of the invention taken in conjunction with the accompanying figures showing illustrative embodiments of the invention.

BRIEF DESCRIPTION OF DRAWINGS

For a complete understanding of the present invention and the advantages thereof, reference is now made to the following description taken in conjunction with the accompanying drawings in which like reference numerals indicate like features and wherein.

DETAILED DESCRIPTION

Figure 1:
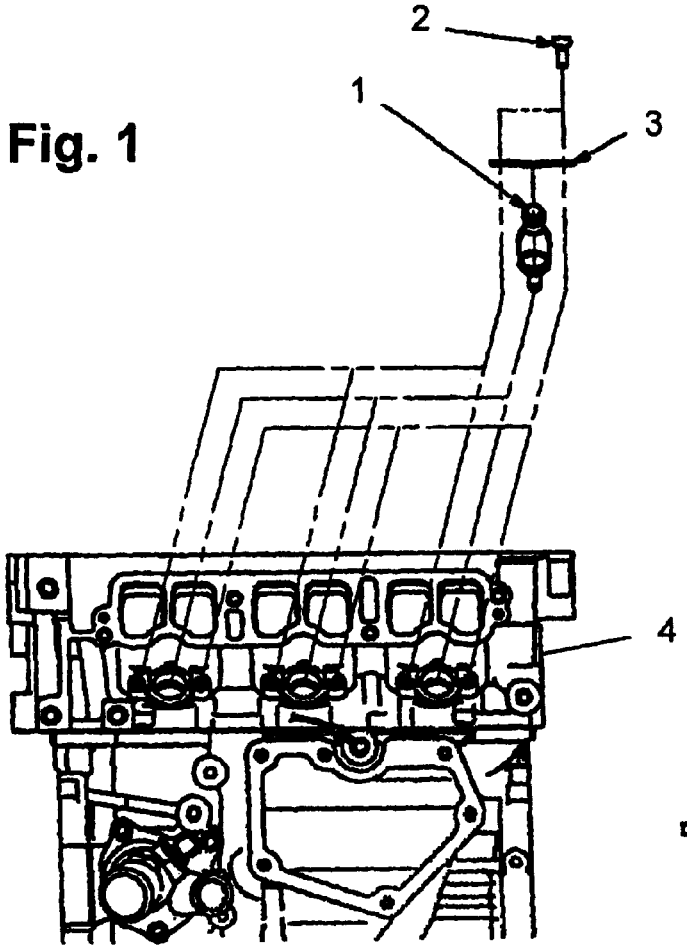
FIG. 1 shows diagrammatically an exemplary cylinder head of an internal combustion engine with an exploded view of the fuel injectors used therein.

FIG. 1 shows a side view of an internal combustion engine. In the illustration, the fuel injectors are removed from the associated bores in the cylinder head 4, one fuel injector 1 being illustrated representatively in an exploded view, in order to illustrate its type of fastening in said bores.

Figure 2:
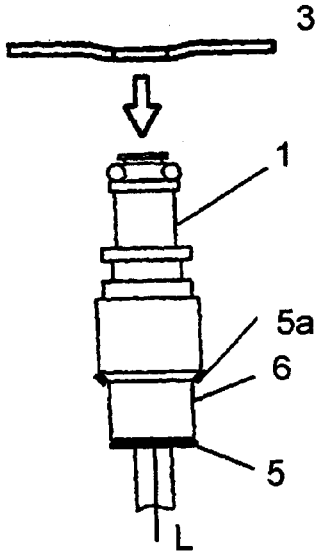
FIG. 2 shows a side view of a fuel injector according to FIG. 1.

FIG. 2 illustrates the fuel injector 1 in more detail in an enlarged side view. It can be seen here that the fuel injector 1 is constructed essentially cylindrically with a longitudinal axis L. The fuel injector 1 is inserted into the bores of the cylinder head 4 in the direction of this longitudinal axis L. After the widened middle portion 6 of the fuel injector 1 comes into abutment on the edge of the bore in the cylinder head, said fuel injector is fastened to the cylinder head with the aid of the stopper 3. The stopper 3 has a central perforation and sits with the edges of this perforation on the upper end face of the fuel injector 1, in order to subject the latter to an axial force (that is to say, a force in the direction of the longitudinal axis L, see the arrow in FIG. 2).

Whereas, in the prior art, the fuel injector sits directly with the end faces of the widened middle portion 6 on corresponding contact faces at the edge of the bore in the cylinder head, according to the invention a damping element in the form of a multiple shim 5 or alternatively 5*a* is arranged between said contact faces on the fuel injector 1, on the one hand, and on the cylinder head 4, on the other hand. Such a shim can be manufactured very easily and mounted on the fuel injector 1.

Figure 3:
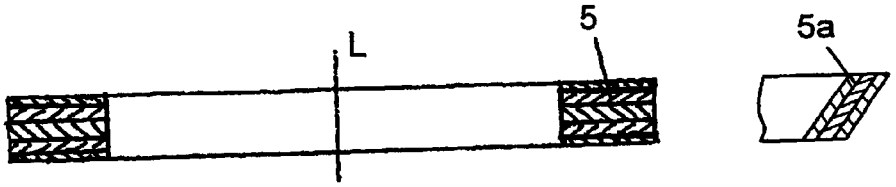
FIG. 3 shows a cross section through a multiple shim for noise damping.

FIG. 3 shows the shim 5 or 5*a* in cross section. It can be seen that the shim consists, in the example illustrated, of five different plies that, with an individual thickness of about 0.5 mm, result in a total thickness of about 2.5 mm. The individual plies may have the same or else different thicknesses. Furthermore, they may consist of the same material or of different materials, the shim 5 being produced preferably from metal, rubber and/or a plastic, such as, for example, Teflon.

Although the present invention has been described in connection with particular embodiments thereof, it is to be understood that various modifications, alterations and adaptations may be made by those skilled in the art without departing from the spirit and scope of the invention. It is intended that the invention be limited only by the appended claims.

What is claimed is:

1. A fuel injection arrangement for an internal combustion engine, comprising:

a fuel injector mounted on the cylinder head of the internal combustion engine, said fuel injector having a contact face for cooperation with the cylinder head; and a damping material disposed between the contact face of said fuel injector and the cylinder head, wherein said damping material comprises a plurality of plies.

2. The fuel injection arrangement according to claim 1, wherein said damping material surrounds said fuel injector annularly.

3. The fuel injection arrangement according to claim 1, wherein the damping material has a total thickness of about 2.5 mm.

4. The fuel injection arrangement according to claim 1, wherein said damping material comprises a metal material.

5. The fuel injection arrangement according to claim 1, wherein said damping material comprises a rubber material.

6. The fuel injection arrangement according to claim 1, wherein said damping material comprises a plastic material.

7. The fuel injection arrangement according to claim 1, wherein said damping material is Teflon.

* * * * *